United States Patent [19]

Bitsakos

[11] Patent Number: 5,069,389

[45] Date of Patent: Dec. 3, 1991

[54] ADAPTER FOR AN AIR SPRAY PAINT GUN

[76] Inventor: Constantine Bitsakos, 26125 Oakflat Ct., Newhall, Calif. 91321

[21] Appl. No.: 432,950

[22] Filed: Nov. 7, 1989

Related U.S. Application Data

[63] Continuation-in-part of Ser. No. 264,937, Oct. 31, 1988, abandoned.

[51] Int. Cl.[5] ..... B05B 7/30

[52] U.S. Cl. ..... 239/289; 239/345; 239/346; 239/526

[58] Field of Search ..... 239/289, 345, 346, 377, 239/379, 525, 526

[56] References Cited

U.S. PATENT DOCUMENTS

| | | | |
|---|---|---|---|
| 533,489 | 2/1895 | Ogram | 239/373 |
| 1,273,784 | 7/1918 | Paasche | 239/526 |
| 1,777,925 | 10/1930 | Kollmann . | |
| 2,005,776 | 6/1935 | Downs | 239/366 |
| 2,157,726 | 5/1939 | Zumft | 239/379 |
| 2,648,569 | 8/1953 | Vose | 239/526 |
| 2,757,048 | 7/1956 | Balmer | 239/526 |
| 2,886,252 | 5/1959 | Ehrensperger | 239/526 |
| 3,003,704 | 10/1961 | Roche . | |
| 3,236,459 | 2/1966 | McRitchie | 239/345 |
| 3,756,512 | 9/1973 | Dyal . | |
| 3,815,819 | 6/1974 | Hamlin . | |
| 3,829,023 | 8/1974 | Bouillard et al. | 239/526 |
| 3,866,838 | 2/1975 | Miles | 239/526 |
| 4,174,071 | 11/1979 | Lau et al. | 239/365 |
| 4,978,072 | 12/1990 | Kurowski | 239/346 |

FOREIGN PATENT DOCUMENTS

| | | | |
|---|---|---|---|
| 216722 | 5/1907 | Fed. Rep. of Germany | 239/345 |
| 247846 | of 1911 | Fed. Rep. of Germany | 239/345 |
| 729382 | 11/1942 | Fed. Rep. of Germany | 239/345 |
| 333908 | 8/1930 | United Kingdom | 239/345 |
| 498772 | 1/1939 | United Kingdom | 239/379 |
| 726455 | 3/1955 | United Kingdom | 239/332 |

*Primary Examiner*—Andres Kashnikow
*Attorney, Agent, or Firm*—John J. Posta, Jr.

[57] ABSTRACT

The adapter is useful in providing overhead gravity feed of paint to a conventional air spray paint gun having a bottom paint inlet port. The adapter includes a paint receptacle with a closable top lid and a bottom outlet. The receptacle can be transparent and bear volume indicia so that the amount of paint left in the receptacle can be estimated as spraying proceeds. The receptacle lid can be hinged and bear a releasable latch plate. The adapter also includes a conduit, the upper end of which is releasably connected to the receptacle at the outlet. The conduit depends from the receptacle and is adapted to support it in the upright position directly above an air spray paint gun. The conduit includes an upper laterally and downwardly adapted to flank the side of the spray gun curved portion, a transverse lower portion connected to the lower end of the upper portion and an upwardly directed central lower end bearing a connector to pivotably connect the conduit to the bottom paint inlet port of an air spray paint gun. Thus, the position of the paint receptacle and conduit can be changed by pivoting the conduit. Moreover, in one embodiment, the transverse portion is long enough to enable the upper portion of the conduit to be swung around the front of the nozzle to switch sides thereof. When the upper portion is also curved forwardly or rearwardly, such switching selectively centers the receptacle over the nozzle or handle to facilitate painting selected areas of the floor, ceiling or walls of a structure. The conduit can also include a stop cock or valve to close paint flow to the gun from the receptacle. The valve can be connected to and operated by the gun trigger.

14 Claims, 5 Drawing Sheets

FIG. 1
(PRIOR ART)
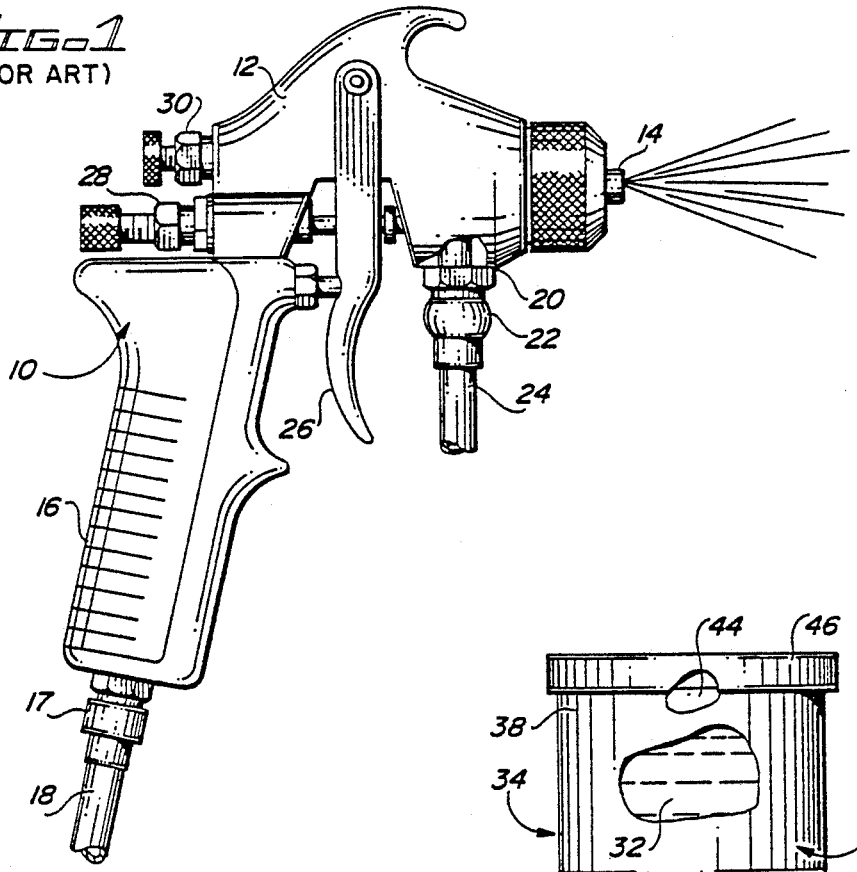
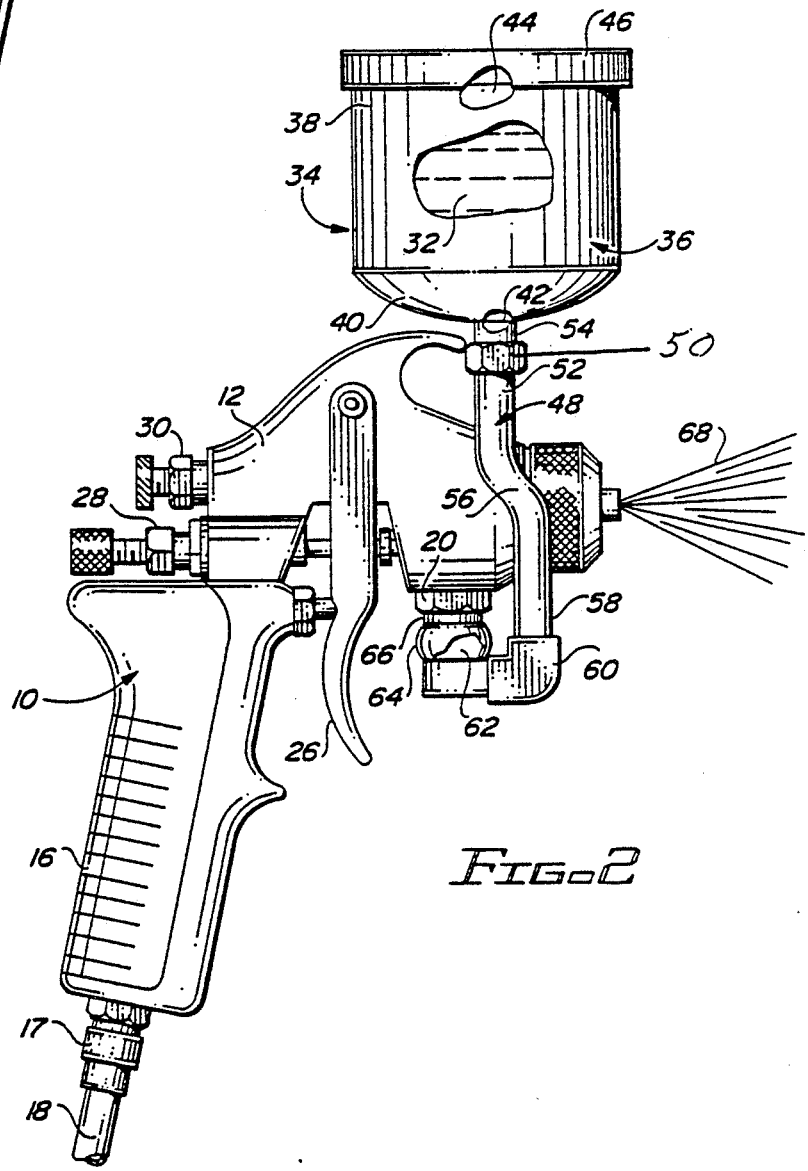
FIG. 2

ADAPTER FOR AN AIR SPRAY PAINT GUN

This is a continuation-in-part of application Ser. No. 07/264,937 filed Oct. 31, 1988 now abandoned.

BACKGROUND OF THE INVENTION

1. Field of the Invention

The present invention generally relates to paint equipment and more particularly to an improved adjustable adapter for converting a conventional bottom feeding air spray paint gun to an overhead gravity feed gun.

2. Prior Art

The most popular types of air spray paint guns currently in use are releasably connectable to a source of paint such as a remote bucket, can or other remote source by a depending supply line, or are connected to a depending container hanging from the gun. Paint is delivered to the gun either by suction, as when air is passed across the top of the paint receptacle and a venturi effect is created, or by pressure, as when air is injected into the paint receptacle. In any event, the paint enters the gun through a bottom inlet part adjacent the front end of the gun and is sprayed out the front nozzle of the gun by air passing forward through the gun from a pressurized air source connected to the gun handle.

Various gravity feed air spray paint guns are also in use for special purposes. In such circumstances, specially designed guns are used. A typical such gun has a top paint inlet port directly connected to an overhead paint receptacle so that the paint is gravity fed directly into the gun. Such guns cannot be used with depending paint sources. There is a need for both types of guns, which are relatively expensive.

Accordingly, there is a need for a simple mechanism which will adapt the more popular bottom feeding air spray paint guns to overhead feed use to duplicate the effects of the overhead feeding guns without necessitating rebuilding or extensively modifying the bottom feeding guns.

SUMMARY OF THE INVENTION

The improved adapter of the present invention satisfies all the foregoing needs. The adapter is substantially as set forth in the Abstract of the Disclosure.

Thus, it comprises a paint receptacle having a bottom outlet and an openable top lid. The receptacle can be transparent and bear volume-indicating indicia, if desired, and/or a latch. The adapter also includes a conduit which depends from and supports the receptacle in an upright position directly above an air spray paint gun. The upper end of the conduit is connected to the receptacle outlet.

The conduit includes a preferably forwardly or rearwardly and a laterally downwardly curved upper portion, a transverse portion connected to the lower end of the upper portion, and an upwardly directed lower end connected to the transverse portion and bearing a connector for releasably pivotally connecting the conduit and receptacle assembly to the bottom paint inlet port of a conventional air spray paint gun and better centering of the receptacle above the gun.

In one embodiment, the transverse portion is long enough to be able to pivot the conduit around the spray gun from one side to the other so that the upper portion which in one position may be curved forward will curve rearwardly in the opposite position, thus selectively positioning the receptable over the center of the handle or nozzle for improved spraying of difficult to spray locations.

The conduit can also include a stop cock or valve to block or regulate the flow of paint to the gun. The stop cock is preferably near the receptacle and the valve is preferably in the lower end or transverse portion of the conduit near the gun trigger when the adapter is connected thereto. Preferably, the valve includes an operating stem connectable to and operated by the trigger. The adapter is simple, durable, inexpensive and efficient.

Further features of the adapter of the present invention are set forth in the following detailed description and accompanying drawings.

DRAWINGS

FIG. 1 is a schematic side elevation of a typical conventional bottom feeding air spray paint gun;

FIG. 2 is a schematic side elevation, partly broken away, showing the gun of FIG. 1 connected to a first preferred embodiment of the gravity feeding adapter of the present invention;

Figure 7:
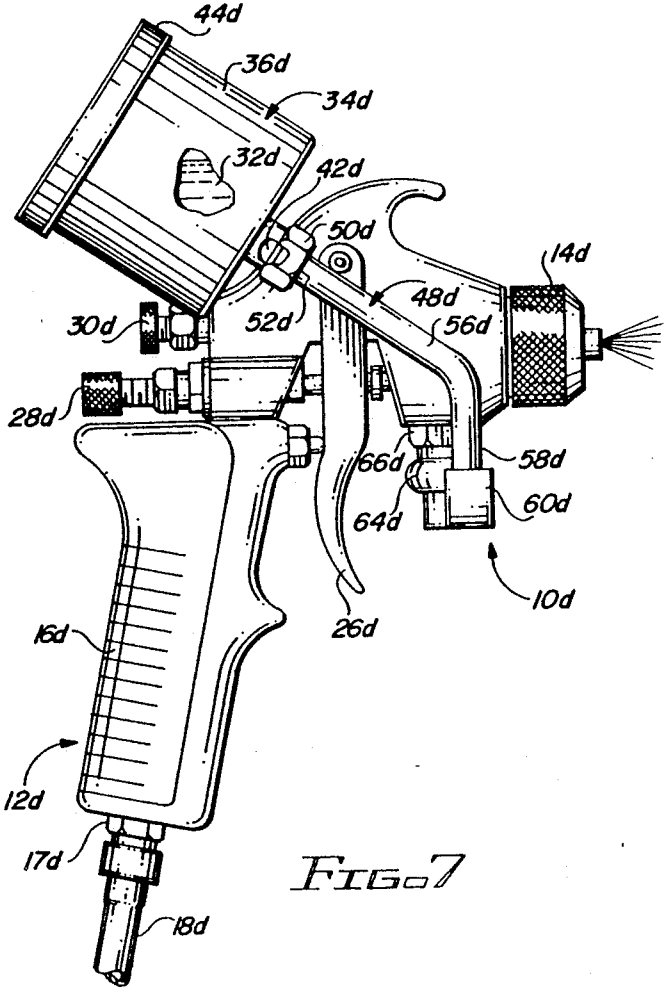
FIG. 7 is a schematic side elevation of the gun of FIG. 2 connected to a fifth preferred embodiment of the improved adapter of the present invention.
Figure 11:
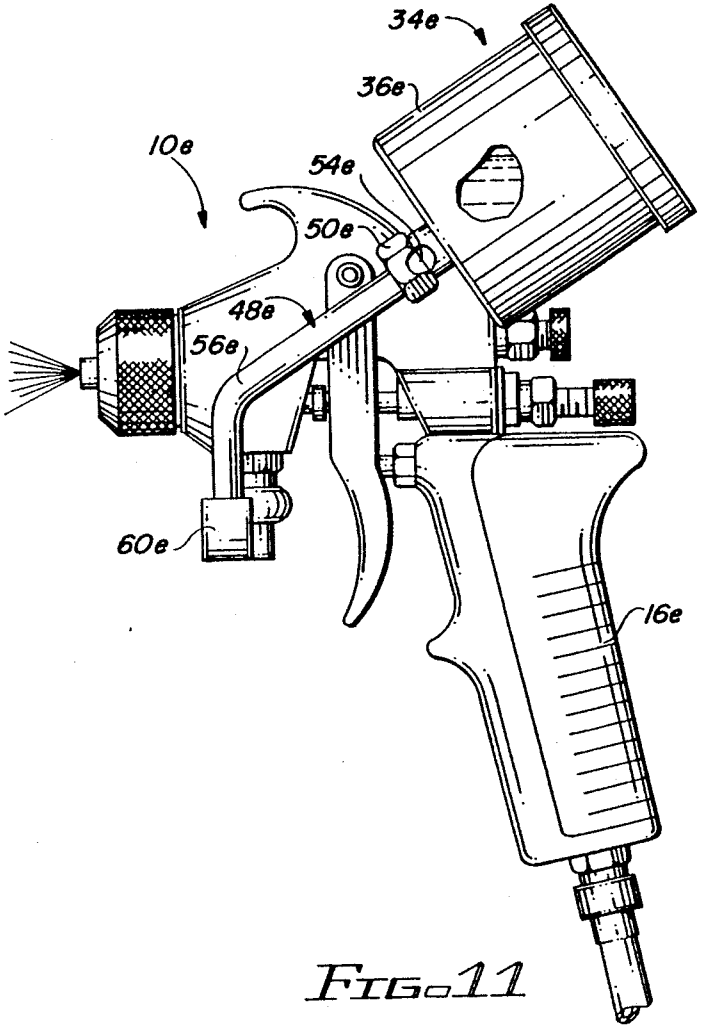
Figure 10:
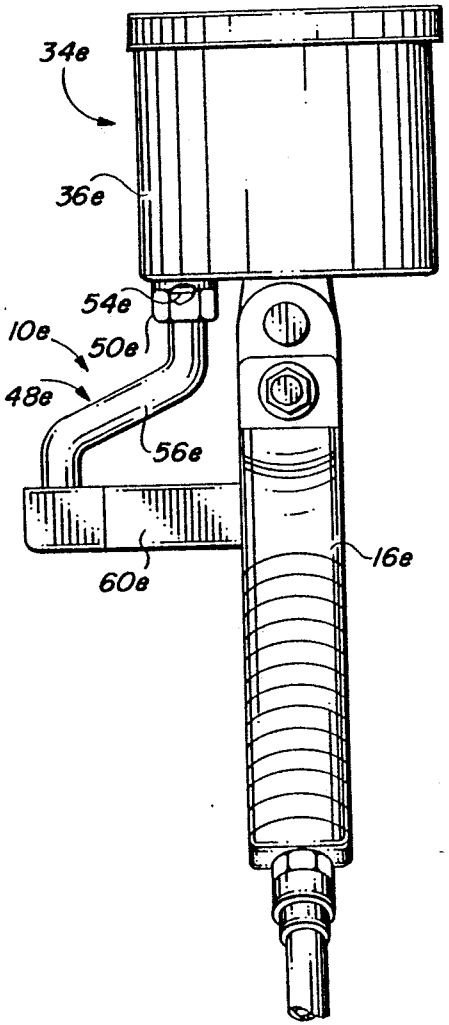
Figure 9:
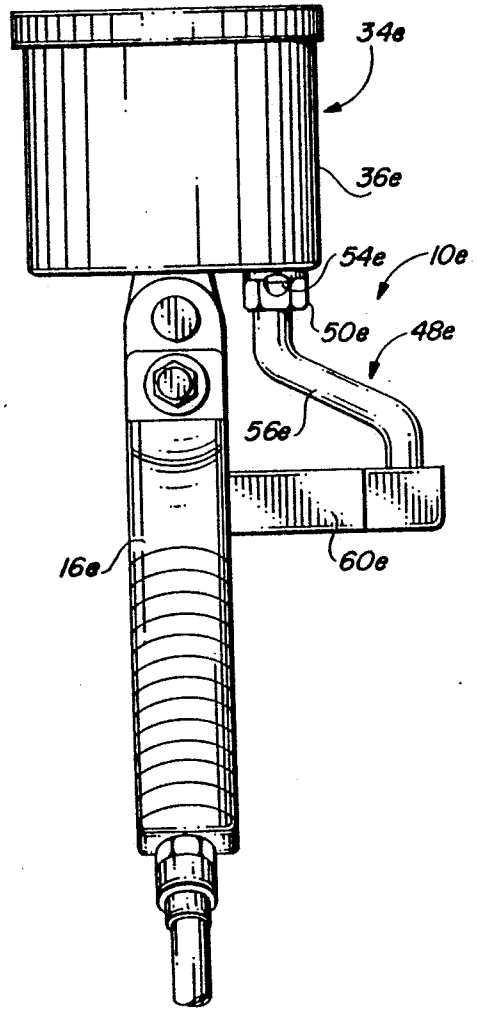

FIGS. 9 and 10 are schemation rear perspective views of the gun of FIG. 2 connected to a sixth preferred embodiment of the improved adapter of the present invention; and, FIG. 11 is a schematic side elevation of the gun and adapter of FIGS. 9 and 10 swung to the receptacle forward position where such receptacle is positioned over the gun nozzle, rather than over the handle, as shown for the embodiment depicted in FIG. 7.

DETAILED DESCRIPTION

FIGS. 1, 2 & 6

In FIGS. 1, a conventional bottom feeding air spray paint gun is schematically shown. Thus, gun 10 comprises a housing 12 which includes a front paint spray exit nozzle 14 and a rear depending handle 16, the latter being releasably connectable by a fitting 17 to a line 18 extending down to a remote source of air pressure (not shown). Housing 12 includes a bottom paint feeding inlet port 20 connected by a fitting 22 to a depending paint feed line 24.

Gun 10 also includes a trigger 26, an air pressure valve or flow control regulator 28 and a paint volume—fan adjustment control regulator 30.

Inasmuch as the source of paint (not shown) is below gun 10, when the air pressure through line 18 is stopped, the flow of paint to housing 12 automatically stops. When gun 10 is in operation, paint is pulled by suction to housing 12 by a venturi effect caused by air passing over inlet 20 or paint rises in line 24 under pressure. Gravity allows the paint to pass back down line 24 when the pressure or suction is removed.

Figure 6:
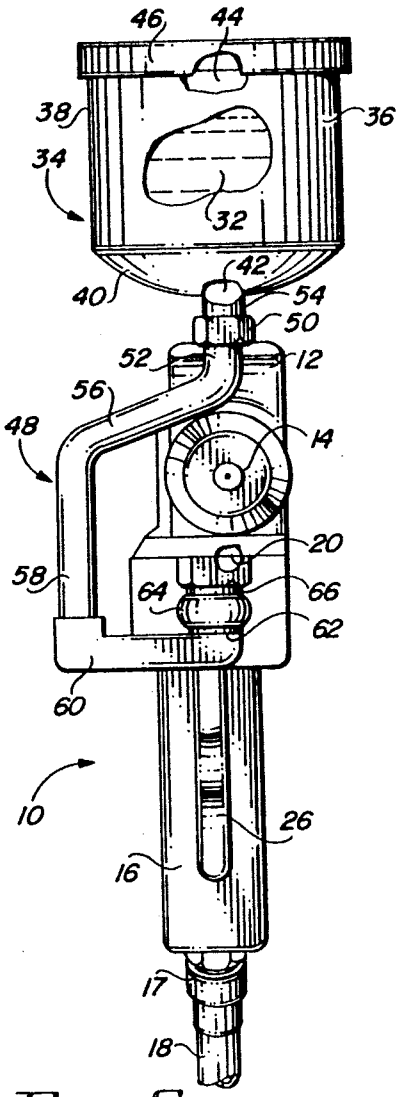
FIG. 6 is a schematic front elevation of the gun and adapter of FIG. 5.

FIGS. 2 & 6 schematically depict a first preferred embodiment of the improved adapter of the present invention installed on the gun of FIG. 1 to convert it to a gravity feeding gun for use, for example, when paint 32 (FIGS. 2 & 6) is heavy and/or thick and/or when the paint needs to be applied in a thick layer. Thus, adapter 34 is shown which comprises a paint receptacle 36 having closed sides 38 and bottom 40, a bottom paint outlet 42 and an open top 44 releasably covered by a removable top lid 46.

Receptacle 36 may be of wood, metal, plastic, rubber, ceramic or the like. Receptacle 36 is connected to a depending self-supporting conduit 48 which may be of metal, rubber, plastic or the like and which holds receptacle 36 in an upright position directly above and centered over gun 10 when adapter 34 is attached thereto. Conduit 48 bears a fitting 50 at its upper end 52, which fitting 50 is releasably received over pipe 54 connected to and depending from receptacle 36 so as to enclose and form part of outlet 42. Conduit 48 includes an upper elongated portion 56 which is slightly curved outwardly and downwardly so as to center receptacle 36 directly over gun 10 for better weight distribution.

To the bottom end 58 of portion 56 is connected transverse portion 60 which runs rearwardly below the main portion of housing 12 in front of and in line with trigger 26. Transverse portion 60 is also connected to the lower end 62 of conduit 48, which end 62 is directed upwardly and bears fitting 64 releasably and pivotably connecting adapter 34 to a pipe 66 forming part of paint inlet port 20 of housing 12.

With adapter 34 in place on gun 10, as shown in FIG. 2, paint 32 in receptacle 36 flows by gravity down through conduit 48 and up through inlet port 20 into housing 12 where it is entrained in pressurized air entering housing through line 18 and is blown out through nozzle 14 as a fine spray 68. Accordingly, bottom feeding gun 10 can be used in the gravity paint feeding mode for improved results. It should also be noted that receptacle 36 is perfectly centered over gun 10 for optimal balance and that conduit 48 can be pivoted through fitting 64 so as to move portions 56 and 60 thereof closer to or further away from the side of gun 10, as needed for optimal spraying.

FIG. 3

Figure 3:
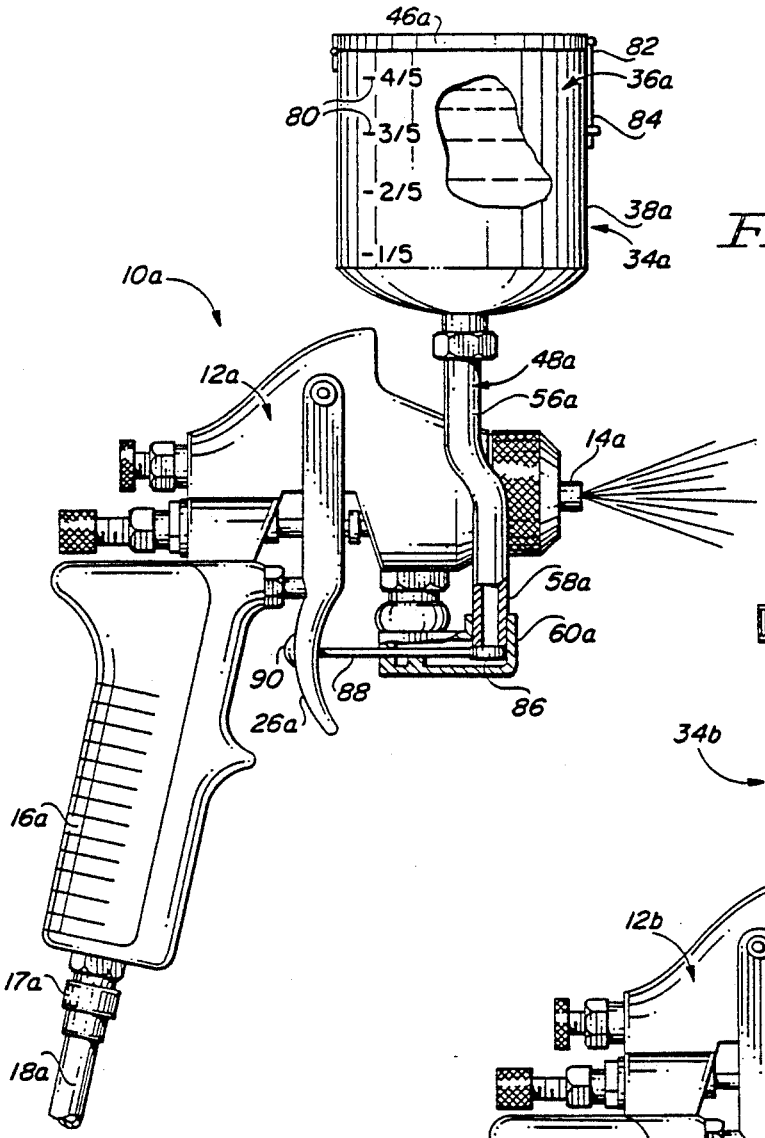
FIG. 3 is a schematic side elevation, partly broken away, showing a second conventional bottom feeding air spray paint gun connected to a second preferred embodiment of the improved adapter of the present invention.

A second preferred embodiment of the improved adapter of the present invention is schematically depicted in FIG. 3. Thus, adapter **34*a* is shown in place on a bottom feeding air spray paint gun 10*a*. Components of adapter 34*a* and gun 10*a* similar to those of FIGS. 1 and 2** bear the same numerals, but are succeeded by the letter "a".

Gun **10*a* is substantially identical to gun 10, except in shape. Adapter 48*a* is substantially identical to adapter 48**, except as follows:

a) receptacle **36*a* is transparent and bears indicia 80 visually indicating the volume of paint 32*a* in receptacle; moreover, lid 46*a* is hinged to receptacle 36*a* at one end and bears depending hinged latch plate 82 at the opposite end thereof to releasably lock it to receptacle 36*a* by rung 84 extending from side 38*a* through plate 82**;

b) transverse portion **60*a* of conduit 48*a* includes a valve 86 normally seated against and closing the bottom end 58*a* of portion 56*a* but movable by trigger 26*a* rearwardly to unblock end 58*a* and allow paint 32*a* to flow into housing 12*a* ; valve 86 includes an elongated operating arm or stem 88, the rear end 90 of which passes around and is releasably connected to the rear of trigger 26*a*, so that rearward movement of trigger 26*a* opens valve 86 and forward movement of trigger 26*a* to the position shown in FIG. 3 closes valve 86**.

FIG. 4

Figure 4:
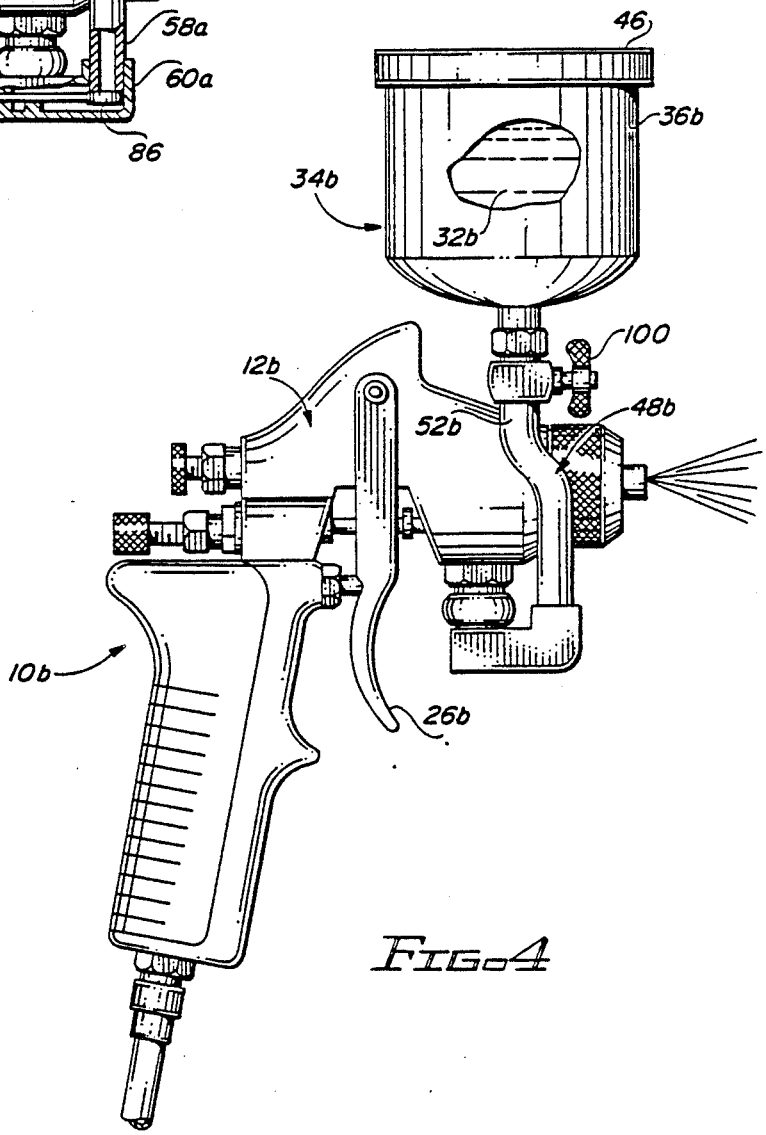
FIG. 4 is a schematic side elevation, partly broken away, showing a third conventional bottom feeding air spray paint gun connected to a third preferred embodiment of the improved adapter of the present invention.

A third preferred embodiment of the improved adapter of the present invention is schematically shown in FIG. 4 releasably connected to a third embodiment of a conventional bottom feeding air spray paint gun **10*b*. Thus, adapter 34*b* is shown. Components of adapter 34*b* and gun 10*b* similar to those of adapter 34 and gun 10** bear the same numerals but are succeeded by the letter "b".

Gun **10*b* is substantially identical to gun 10. Adapter 34 differs from adapter 34** only as follows:

adapter **34*b* has a hand-turnable stop cock 100 of conventional construction which is disposed in upper end 52*b* of conduit 48*b* and extends outwardly thereof to block, open and regulate the flow of paint 32*b* from receptacle 36*b* to housing 12*b*. Thus, paint 32*b* can be blocked from entering housing 12*b* for easier cleanup of conduit 48*b* and gun 10*b***.

Adapter **34*b* has the other advantages of adapter 34**.

FIG. 5

Figure 5:
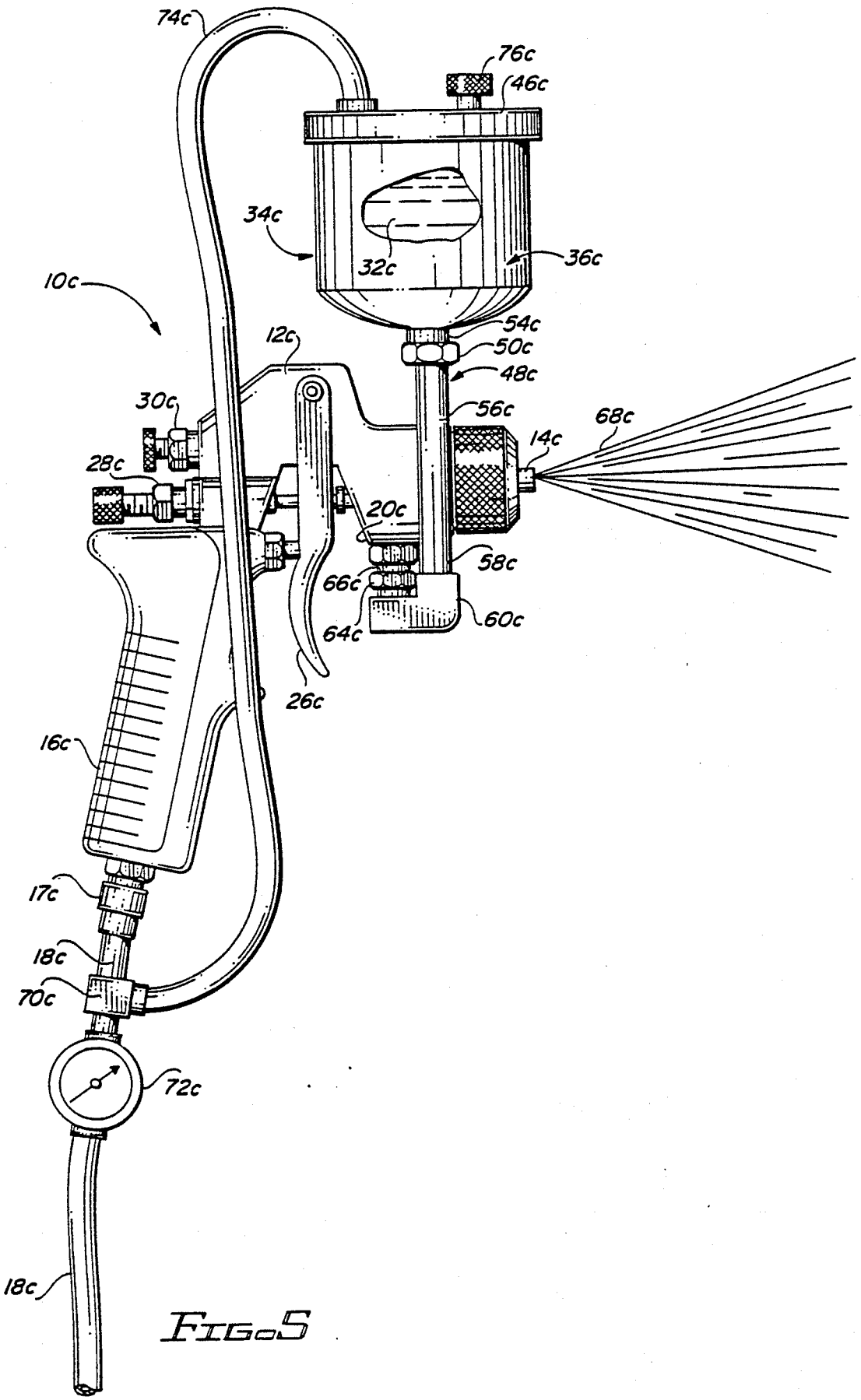
FIG. 5 is a schematic side elevation, partly broken away, showing a conventional bottom feeding air spray paint gun connected to a fourth preferred embodiment of the improved adapter of the present invention.

A fourth preferred embodiment of the improved adapter of the present invention is schematically shown in FIG. 5 releasably connected to a convenient bottom feeding air spray paint gun **10*c*, but which also has the receptacle 36*c* subjected to additional pressure. Thus, adapter 34*c* is shown. Components of adapter 34*c* and gun 10*c* similar to those of adapter 34*b* and gun 10*b*** bear the same numerals but are succeeded by the letter "c".

Gun **10*c* is substantially identical to gun 10*b*. The gun and adapter assembly of FIG. 5 differs from the gun and adapter assembly of FIG. 4** in the following respects:

an air pressure splitter fitting **70*c* is disposed between fitting 17*c* and air pressure meter 72*c***.

air pressure bypass line **74*c* interconnects the air pressure source to receptacle 36*c* through an opening (not shown) in lid 46*c***.

a pressure relief valve **76*c* is provided on lid 46*c* to relieve any pressure build-up in receptacle 36*c***.

elongated portion **56*c* of conduit 48*c* extends outwardly and downwardly, but not forwardly, as in the case in FIGS. 2–4**.

The asembly of FIG. 5 provides three types of pressure to move especially heavy paint **32*c*** to the gun; namely, 1) venturi suction, 2) gravity pressure, and 3) an outside source of air pressure, thereby resulting in increased efficiency of operation.

Adapter **34*c* has all the other advantages of adapter 34*b***.

Figure 8:
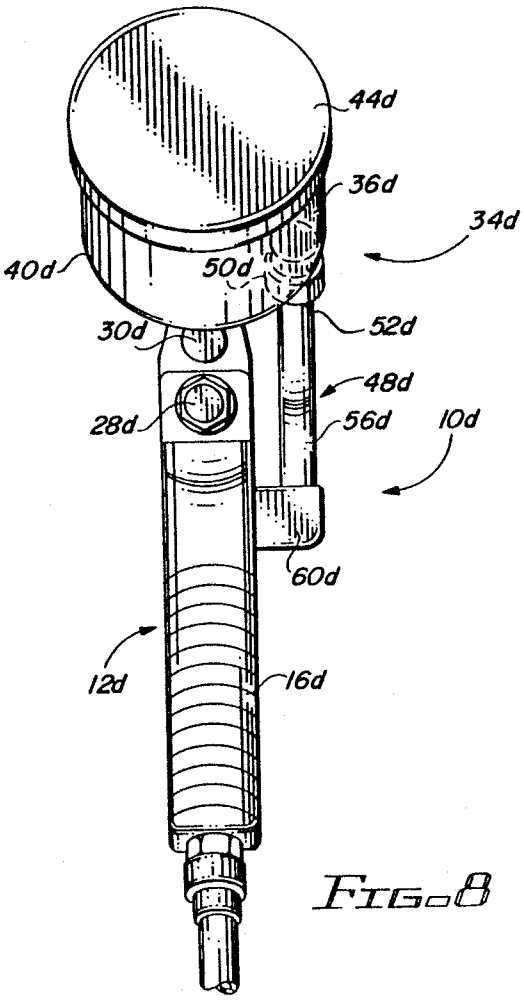
FIG. 8 is a schematic rear perspective view of the gun and adapter of FIG. 7.

A fifth preferred embodiment of the improved adapter of the present invention is schematically depicted in FIGS. 7 & 8. Thus, adapter **34*d* is shown in gun 10***d*. Components thereof similar to those of adapter 34 and gun 10 bear the same numerals, but are succeeded by the letter "d".

Gun 10*d* is identical to gun 10. Adapter 34*d* differs from adapter 34 only as follows:

a) portion 56*d* of conduit 48*d* does not bend laterally but bends rearwardly (FIG. 7) to position receptacle 36*d* over handle 16;

b) pipe 54*d* is eccentric; that is, is positioned adjacent the outer periphery of the bottom 40*d* of receptacle 36*d* so that receptacle 36*d* is centered over handle 16*d*, even though portion 56*d* is not curved laterally.

If desired, fitting 64*d* can be detached from gun 10*d* and adapter 34*d* can be switched from one side to the other, so that receptacle 36*d* projects forwardly over nozzle 14*d*, if desired, for certain painting applications. Adapter 34*d* has the other advantages of adapter 34.

FIGS. 9, 10 and 11.

A sixth preferred embodiment of the improved adapter of the present invention is schematically depicted in FIGS. 9, 10 and 11. Thus, adapter 34*e* is shown. Components thereof similar to those of adapter 34 bear the same numerals, but are succeeded by the letter "e".

Adapter 34*e* is substantially identical to adapter 34*d*, except as follows:

a) transverse portion 60*e* is of sufficiently greater length than portion 60*d* so as to enable adapter 34*e* to be rotated around the front of gun 10*e* from one side to the other, as shown in FIGS. 9, 10 and 11, without removing adapter 34*e* from gun 10*e*, whereby receptacle 36*e* can selectively project rearwardly over handle 16*e* or over the front of gun 10*e* as shown in FIG. 11, as desired; and, b) portion 56*e* bends laterally to compensate for the greater length of transverse portion 60*e*. Adapter 34*e* has the other advantages of adapter 34*d*.

Various other modifications, changes, alterations and additions can be made in the improved adapter of the present invention and its components and parameters. All such modifications, changes, alterations and additions as are within the scope of the appended claims form part of the present invention.

What is claimed is:

1. An improved adjustable adapter for an air spray paint gun having an elongated rear handle extending along a first longitudinal axis and an elongated front nozzle portion extending along a second longitudinal axis, wherein said first longitudinal axis and said second longitudinal axis lie in a first plane, said nozzle portion having a paint inlet port on the underside thereof, said adapter comprising:

a) a paint-receiving receptacle having side conconected to a bottom with an outlet in said bottom, b) an elongated, rigid conduit having, 1) a top portion extending laterally away from said paint gun, 2) a bottom portion extending laterally away from said paint gun, and 3) a mid-portion extending vertically between said top portion and bottom portion, and located to the side of said paint gun, c) means for connecting the top portion of said conduit to the outlet in the bottom of said container, d) means for connecting the bottom portion of said conduit to said paint inlet port, e) whereby said conduit positions the center of gravity of said receptacle above said gun, and substantially within aid first plane.

2. The improved adapter of claim 1 wherein said top portion is curved rearwardly to position said receptacle over and adjacent to the handle of said gun for improved balance.

3. The improved adapter of claim 1 wherein said top portion is curved forwardly to position said receptacle above the nozzle portion of said gun for spraying a ceiling.

4. The improved adapter of claim 1 wherein said conduit can be rotated about the inlet port while connected thereto to selectively position the conduit on either of opposite sides of said gun, whereby said conduit extends selectively rearwardly or forwardly.

5. The improved adapter of claim 4 wherein said conduit is of sufficient length to allow said conduit to pivot around said nozzle portion to extended said top portion selectively rearwardly or forwardly of said nozzle portion.

6. The improved adapter of claim 1 wherein said conduit has means for regulating the flow of paint from said receptacle to said gun.

7. The improved adapter of claim 6 wherein said regulating means comprises a valve disposed in said conduit.

8. The improved adapter of claim 7 wherein said valve is in said bottom portion and includes an operating arm projecting out of said conduit and connectable to a trigger of said gun by said trigger.

9. The improved adapter of claim 1 wherein said receptacle is transparent and includes indicia indicating the volume of paint therein.

10. The improved adapter of claim 1 wherein said receptacle has a hinged lid with a releasable latch plate.

11. The improved adapter of claim 1 and further including:

a pressure source, and conduit means connecting said pressure source to both said air spray paint gun and said paint-receiving receptacle.

12. The improved adapter of claim 11 and further including pressure relief means connected to said receptacle.

13. The adapter of claim 1 wherein the outlet in the bottom of said receptacle is located at the center of the bottom.

14. The adapter of claim 1 wherein the outlet in the bottom of said receptacle is located at a position other than the center of the bottom.

* * * * *